United States Patent [19]

Bishop et al.

[11] Patent Number: 4,562,947

[45] Date of Patent: Jan. 7, 1986

[54] APPARATUS FOR TREATMENT OF CONTINUOUS WEB MATERIAL

[75] Inventors: Thomas D. Bishop, Solihull; David J. G. Bishop, Birmingham, both of England

[73] Assignee: The Deritend Engineering Company Ltd., Birmingham, England

[21] Appl. No.: 401,291

[22] Filed: Jul. 23, 1982

[30] Foreign Application Priority Data

Jul. 25, 1981 [GB] United Kingdom ..... 8123046

[51] Int. Cl.[4] ..... B65H 20/04

[52] U.S. Cl. ..... 226/121; 226/139

[58] Field of Search ..... 226/4, 27, 121, 139; 83/250, 263.1, 403.1, 405

[56] References Cited

U.S. PATENT DOCUMENTS 3,017,796 1/1962 Auer et al. ..... 83/263

3,371,834 3/1968 Willits et al. ..... 226/27

4,451,834 5/1984 Nakajima et al. ..... 226/121 X

*Primary Examiner*—Leonard D. Christian

*Attorney, Agent, or Firm*—C. O. Marshall, Jr.

[57] ABSTRACT

Treatment apparatus for continuous web for producing diecut blanks (for example) has two sets of treatment rolls and the speed of these is adjusted so that although driven at web speed during the treatment portion of each cycle they are accelerated and retarded (or vice versa) during the non-treatment portion of each cycle so as to synchronize the treatment forms on the rolls with the required web areas and avoid wastage. The speed variation is by control of the drive motors for the rolls, but using roll-carried cams connected to gas springs so that energy can be absorbed during retardation and released during acceleration to supplement the motors and thus enable smaller motors to be used.

2 Claims, 6 Drawing Figures

APPARATUS FOR TREATMENT OF CONTINUOUS WEB MATERIAL

This invention relates to apparatus for the treatment of continuous web material in the production of, for example, separate blanks. As used herein the term "treatment" is to be construed as including within its scope operations such as diecutting, crosscutting, printing, and any combination of these.

It is known to use formes mounted on continuously rotating rolls to effect the treatment. Because the length (measured along the web) of the treated area may not be the same as the peripheral dimension of the roll (or a simple fraction thereof e.g. $\frac{1}{2}$ or $\frac{1}{3}$) it would be necessary in simple apparatus to accept a certain wasted area between each two successive treated areas of the web. More sophisticated apparatus reduces or eliminates such wasted areas.

In British Pat. No. 1093723, the treatment apparatus is duplicated and treats alternate areas along the length of the web. The web speed is adjusted between successive operations of the two sets of treatment rolls, for example by slowing down the web and then speeding up again to the required speed for treatment, or the web is speeded up first before it is slowed down, or the web is even stopped and reversed before returning to the forward direction and speed, and by any of these means, according to requirements, wastage can be avoided. Alternatively, similar action is carried out on the treatment rolls during the time when they are not in treatment contact with the web, to the same effect.

British Pat. No. 1324169 proposes mechanical means for causing the web speed variation.

U.S. Pat. No. 4,360,354 proposes electronic means for cyclically varying the speed of the electric drive motor for the treatment rolls. Said application also suggests the use of a flywheel which may be effective to absorb energy at times when the roll is being slowed, and release the energy at times when the roll is being accelerated.

The object of the present invention is to provide a different and improved means for achieving these ends.

In accordance with the present invention considered broadly, web treatment apparaus comprises a treatment roll arranged to be driven at cyclically varying speeds, and connected to spring means so that during times of roll deceleration, energy can be stored in the spring, and during times of roll acceleration energy can be released from the spring to supplement the roll drive means.

The spring may be an air spring, so that the energy absorption is accomplished by gas compression and energy release by gas expansion.

Supplementary gas pressure may be used to assist the gas spring.

The invention is now more particularly described with reference to the accompanying drawings wherein.

Figure 1:
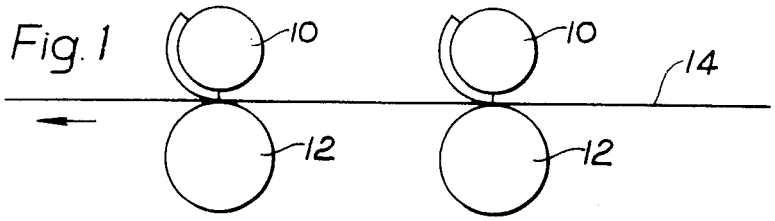
FIGS. 1 to 4 are diagrammatic views showing treatment rolls and web, in order to illustrate the problem concerned.

Referring first to FIG. 1, this shows two sets of treatment rolls consisting of forme carrying rolls 10 and impression rolls 12, and the web 14 is fed through the nips between the pairs of rolls successively, the linear speed of the web being the same as the peripheral speed of the rolls.

Figure 2:
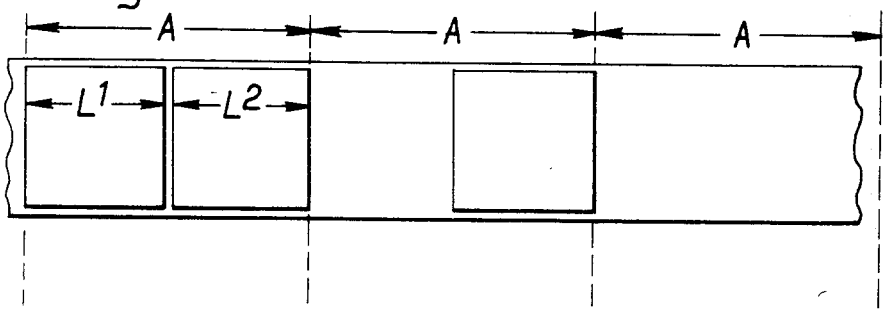

FIG. 2 shows a portion of the length of the web. The dimension A along the length of the web represents the peripheral length (i.e. the circumference) of each of the treatment rolls 10. It will be seen that if the forme length on each roll 10 is L and if L is substantially equal to $\frac{1}{2}$A then L1=L2 and L1+L2=A. Then a series of identical length blanks can be produced out of the web with effectively no waste between successive blanks. This is the ideal condition in which the invention is not required.

But the size of the blank produced by the apparatus is to meet customer's requirements. It is very expensive to produce new treatment rolls of different sizes in order to match blank length with roll periphery, although this is a known solution to the problems. But the invention is concerned with other solutions.

Figure 3:
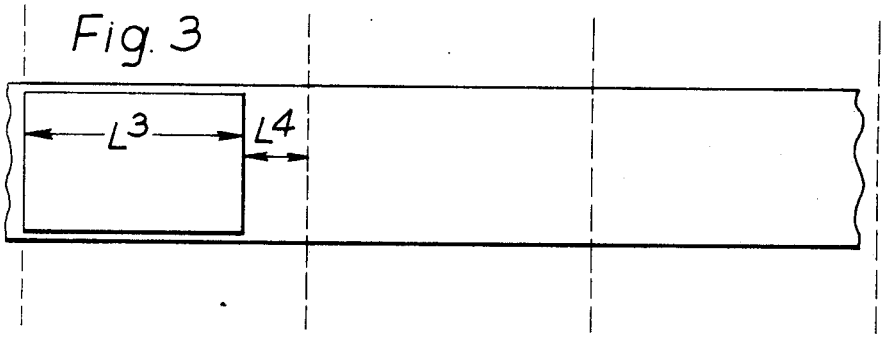

FIG. 3 shows one case where the required blank length L3 occupies more than 180° of treatment roll periphery.

Without some special means the next blank produced by the same forme will overlap the next blank produced by the forme of the second treatment apparatus, because the distance L4 is smaller than the distance L3. This is avoided, using the invention by slowing the roll and subsequently accelerating it (because the forme must be travelling at the same speed as the web when it contacts the web) and the roll must complete one revolution in the time that the web takes to travel a distance of 2×L3.

Figure 4:
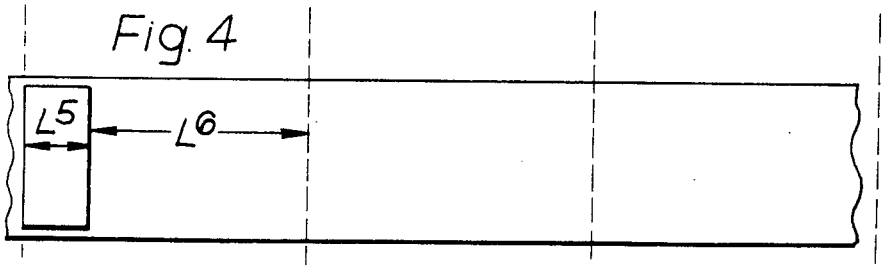

In FIG. 4 the reverse situation applies. The blank L5 occupies less than 180° of roll periphery. The roll has to be accelerated so that the time taken for the roll to turn between the position in which the trailing edge of the forme leaves the web and the position in which the leading edge of the forme contacts the web is the same as the time taken for the actual impression operation (at constant roll and web speed): in other words so that the roll completes one revolution in the time taken for the web to travel a distance of 2×L5.

Whilst the treatment roll speed variation can be effected by control of its motor (alone) effectively a very large motor would then be needed, particularly if wide variations from the 180° condition of FIG. 2 are to be dealt with. The present invention allows much smaller motors to be used by transferring energy from one part of the cycle to the other.

Figure 5:
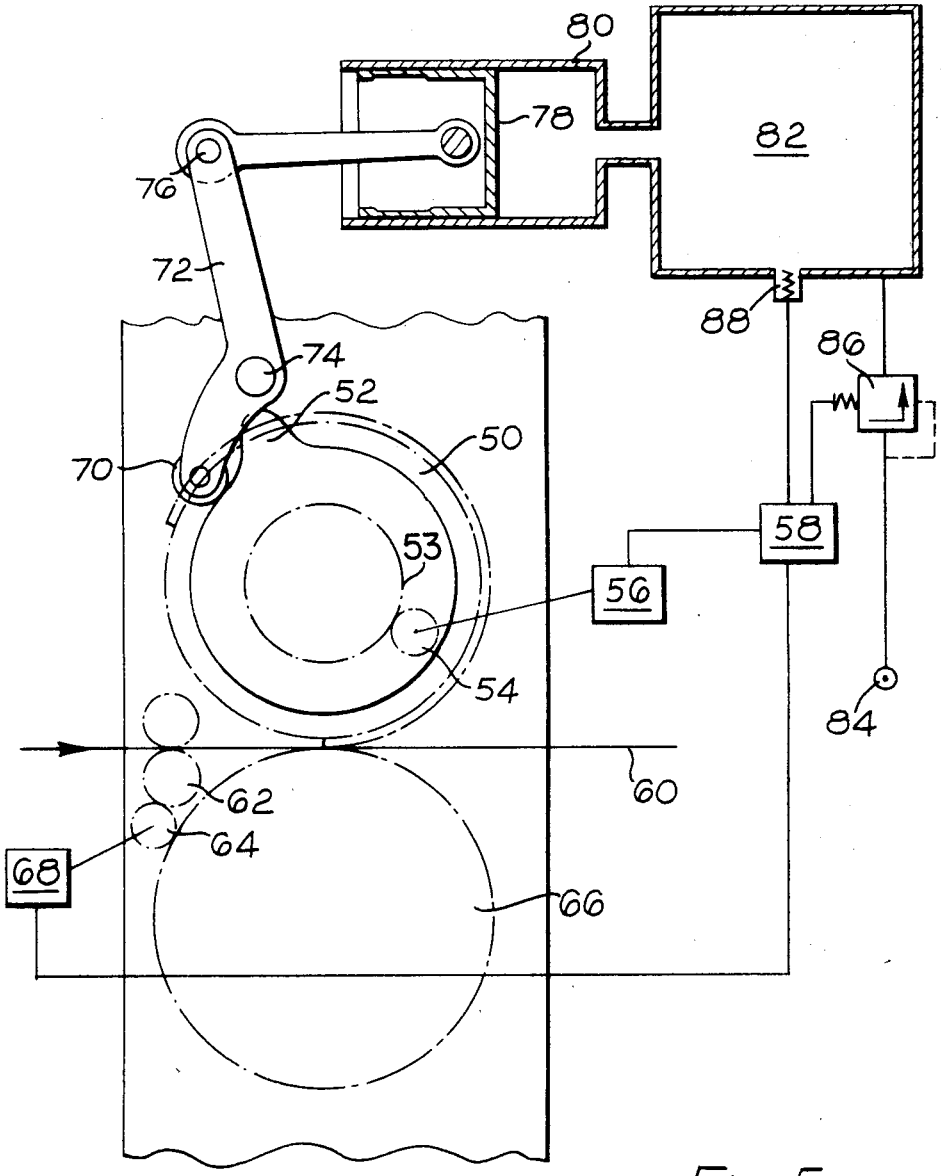
FIGS. 5 and 6 are diagrammatic views of apparatus according to the invention.

The arrangement shown in FIG. 5 is the one for the 180° die length or greater. Here, roll 50 is the one carrying the forme and it has fast with it a cam 52. The roll also has fixed thereto a gear 53 which is driven in a conventional manner from a motor 54 and this is under the control of a motor control unit 56 connected to the microprocessor unit 58.

The web 60 is fed from left to right in the figure by constant speed drive rolls 62 driven in a conventional manner by motor 64 which also drives the impression roll 66 at constant speed. The motor control unit for motor 64 is indicated by the reference numeral 68 and this too is connected to the microprocessor to readout the speed of the motor 64. The microprocessor can compare the speeds of the motors 54 and 64 to make appropriate adjustments from time to time in known manner.

Cam follower 70 is carried on one end of a drive lever 72 pivoted between its ends at 74 and connected at its opposite end 76 to piston 78 of air cylinder 80. The latter is connected to a pressure accumulator or reservoir 82, and a constant pressure (for example) air supply 84 is used to supplement accumulated pressure, so as to maintain this at a level determined by the microprocessor according to the acceleration and retardation required. It will be appreciated that when the forme does extend over 180° only, neither acceleration or retardation will be required and no air pressure will be needed, via pressure regulator valve 86 which is also connected to the microprocessor unit. The latter is connected to the reservoir via a sensor 88.

As and when reservoir pressure falls below a predetermined level, this is read by the sensor and the microprocessor unit operates the regulator valve to admit supplemental air at line pressure.

It will be seen that over a substantial part (in excess of 180°) of the rotation of the roll 50, the cam is effectively inoperative as the cam lobe is restricted to a minor portion of the periphery. The cam is inoperative when cutting or other forme treatment takes place on the web, because the speed of rolls 50 and 66 is then constant under the control of the units 56, 68 via the microprocessor 58.

As treatment terminates, and the trailing edge of the forme leaves the web, cam follower 70 encounters the lobe and the lever is displaced to force the piston into the cylinder and increase the air pressure in the cylinder and in the reservoir. This absorbs energy at the time when the microprocessor is causing the motor 54 to slow the roll, and thus the inertia load due to the momentum of the roll is in whole or part removed, avoiding motor overheating. As the lobe moves past the cam follower, the gas pressure operates on the opposite side of the lobe and thus imparts acceleration to the cam and hence to the roll at the time when the roll is to be brought back to web speed and the gas pressure thus again acts against the roll inertia at the time when the motor 54 is trying to accelerate the roll. Hence again a smaller motor and less risk of overheating is involved.

It will be appreciated that the motor control via the microprocessor unit amounts to substantially continuous comparison of motor speed at different points in the cycle, with a predetermined programme of speeds required to achieve particular results.

Figure 6:
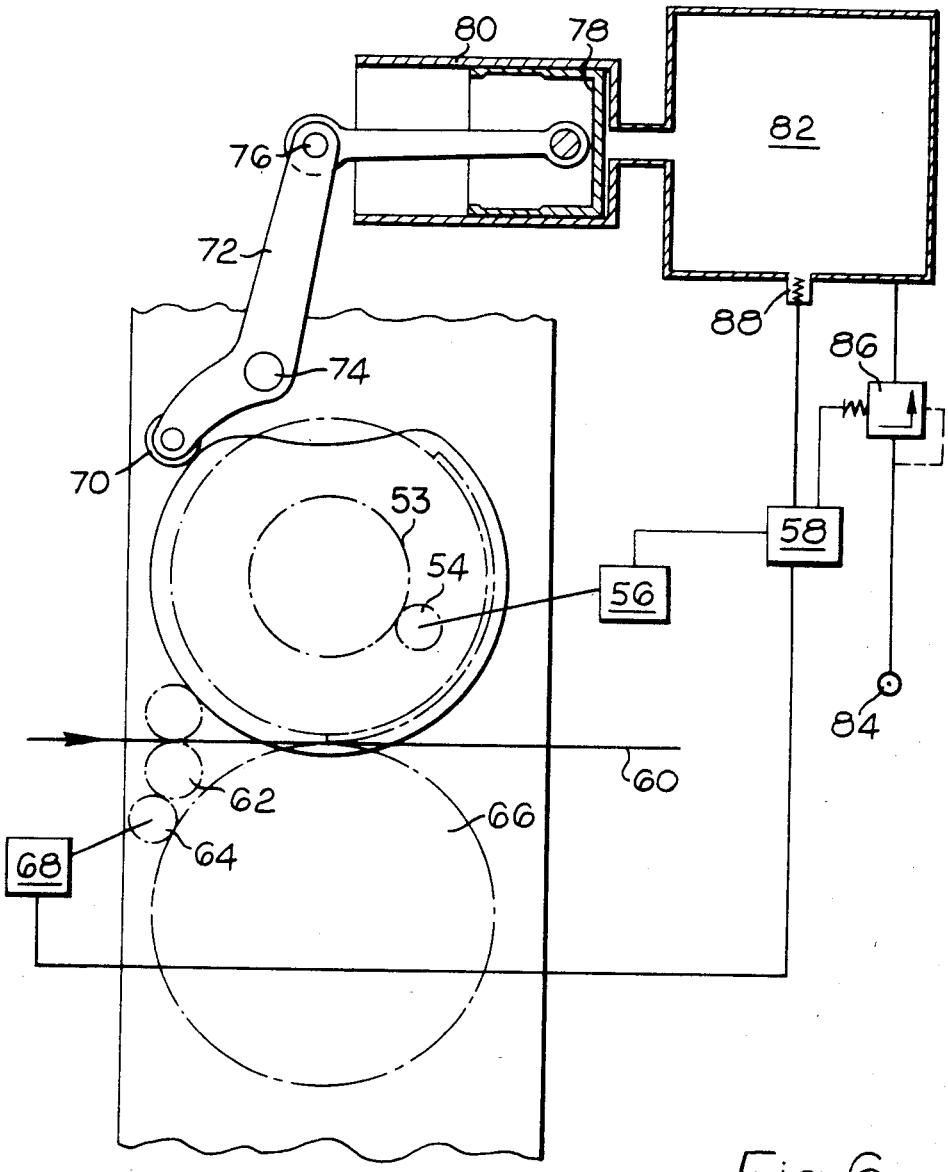

FIG. 6 shows the different case, where the blank is of less than 180° length, and instead of deceleration followed by acceleration, there is acceleration followed by deceleration. The arrangement and operation are substantially the same as in FIG. 5, except that the cam is of different profile to suit these differing requirements.

We claim:

1. Apparatus for treating web material, comprising means for feeding the web material at a constant speed, two pairs of rolls through which the web material passes in succession, means for rotating one roll of each pair at a peripheral speed equal to the speed of the web, web treating means which is carried by the other roll of each pair and which extends over a portion of the periphery of said other roll, a separate motor for driving each of said other rolls, and separate apparatus for controlling each of said motors (a) to drive its roll at a peripheral speed equal to the speed of the web during the time while the web is in contact with the web treating means on its roll, and (b) to vary the speed of its roll at other times in order to complete each revolution of its roll in a period of time which is equal to twice the period of time during which the web is in contact with said web treating means, wherein the improvement comprises a gas cylinder for each of said other rolls, provided with a piston having an inactive position, and an active position in which it compresses gas in the cylinder, means for controlling the gas pressure which exists in the cylinder when the piston is in its inactive position, and mechanism which is connected to the piston and to its roll to move the piston from its inactive position to its active position when the speed of the motor driving its roll is beind decreased, and to move the piston from its active position to its inactive position when the speed of the motor driving its roll is being increased.

2. Apparatus as claimed in claim 1 wherein the mechanism which is connected to said pistion and to its roll comprises a cam fast with said roll.

* * * * *